US007412942B2

(12) United States Patent
Pharo et al.

(10) Patent No.: US 7,412,942 B2
(45) **Date of Patent: *Aug. 19, 2008**

(54) PERSONNEL LOCATION CONTROL SYSTEM WITH INFORMATIONAL MESSAGE PRESENTATION

(76) Inventors: Dan Pharo, 27062 Alabastro Dr., Valencia, CA (US) 91354; Alex J. Humbree, 4620 Jupitor La., Salt Lake City, UT (US) 84124

( * ) Notice: Subject to any disclaimer, the term of this patent is extended or adjusted under 35 U.S.C. 154(b) by 0 days.

This patent is subject to a terminal disclaimer.

(21) Appl. No.: 11/716,957

(22) Filed: Mar. 12, 2007

(65) Prior Publication Data

US 2007/0186842 A1 Aug. 16, 2007

Related U.S. Application Data

(63) Continuation of application No. 10/635,871, filed on Aug. 5, 2003, now Pat. No. 7,188,582, which is a continuation of application No. 10/056,714, filed on Oct. 24, 2001, now abandoned, which is a continuation of application No. 09/307,104, filed on May 6, 1999, now abandoned, and a continuation-in-part of application No. 08/741,619, filed on Oct. 30, 1996, now abandoned.

(60) Provisional application No. 60/084,591, filed on May 7, 1998.

(51) Int. Cl.
*G09F 19/22* (2006.01)
*G07C 11/00* (2006.01)

(52) U.S. Cl. ..... 116/200; 116/201

(58) Field of Classification Search ..... 116/200, 116/201, 205, 209, 63 P, 63 R; 340/332, 340/815.4, 944; 362/152, 153, 153.1; 40/582, 40/612; 404/12, 13, 6, 9; 434/75; 52/174, 52/177, 33, 38; D6/583, 588, 589, 591
See application file for complete search history.

(56) References Cited

U.S. PATENT DOCUMENTS

| | | | | | |
|---|---|---|---|---|---|
| 429,650 | A | * | 6/1890 | Scott | 52/103 |
| 1,521,941 | A | * | 1/1925 | Graf | 404/16 |
| 1,686,363 | A | * | 10/1928 | Baldwin | 40/565 |
| 1,979,979 | A | * | 11/1934 | Martini | 47/33 |
| 1,986,097 | A | * | 1/1935 | Arey | 404/16 |
| 2,065,872 | A | * | 12/1936 | Rockwell | 40/616 |
| 2,085,807 | A | * | 7/1937 | Lindsey | 340/332 |
| 2,680,698 | A | * | 6/1954 | Schnee | 404/35 |
| 2,984,923 | A | * | 5/1961 | Mitchell | 40/323 |
| 2,995,849 | A | * | 8/1961 | Donnellan | 40/618 |
| D197,325 | S | * | 1/1964 | Stoner | D6/598 |
| 3,200,243 | A | * | 8/1965 | McDevitt et al. | 362/153 |
| 3,317,168 | A | * | 5/1967 | Ziph | 248/156 |
| 3,453,660 | A | * | 7/1969 | Daigle et al. | 156/378 |
| 3,969,720 | A | * | 7/1976 | Nishino | 340/815.69 |

(Continued)

*Primary Examiner*—R. A. Smith
(74) *Attorney, Agent, or Firm*—Robert J. Schaap

(57) ABSTRACT

A personnel guidance and location control system for controlling movement of one or more individuals to a particular destination, e.g. guiding one or more individuals in a selected path to a waiting point and then to an activity in advance of that waiting point or otherwise to a particular destination. The system relies upon a plurality of indicators or markers which may be secured to a floor or ground surface and which define guide paths for the one or more individuals. Various floor covering segments can be also secured in desired combinations to achieve a desired guide path.

35 Claims, 6 Drawing Sheets

U.S. PATENT DOCUMENTS 4,040,760 A * 8/1977 Wyckoff ..... 404/14
4,080,087 A * 3/1978 Phillips ..... 404/72
4,089,730 A * 5/1978 Mahn ..... 156/541
4,109,439 A * 8/1978 Feasel ..... 52/667
4,376,596 A * 3/1983 Green ..... 404/35
4,385,586 A * 5/1983 Schriever ..... 116/205
4,401,050 A * 8/1983 Britt et al. ..... 116/205
4,489,669 A * 12/1984 Carman ..... 116/202
4,570,207 A * 2/1986 Takahashi et al. ..... 362/153.1
4,620,816 A * 11/1986 Kupfer ..... 404/6
4,687,369 A * 8/1987 McDonald ..... 404/12
4,737,764 A * 4/1988 Harrison ..... 362/153
4,747,515 A * 5/1988 Kasher et al. ..... 221/116
4,794,373 A * 12/1988 Harrison ..... 340/286.01
4,888,896 A * 12/1989 Sanchez ..... 40/630
4,896,886 A * 1/1990 Colley ..... 473/157
5,123,130 A * 6/1992 Sanders ..... 4/661
5,167,087 A * 12/1992 Plumly ..... 40/600
5,242,242 A * 9/1993 Young ..... 404/12
5,248,152 A * 9/1993 Timmerman ..... 273/444
5,331,918 A * 7/1994 Honigsbaum ..... 116/205
5,335,112 A * 8/1994 Bennett et al. ..... 359/530
5,437,907 A * 8/1995 Peil et al. ..... 428/143
5,476,339 A * 12/1995 Baranowski ..... 404/36
5,516,277 A * 5/1996 Yanagihara et al. ..... 431/2
5,568,785 A * 10/1996 Hazen ..... 116/209
5,593,156 A * 1/1997 Jambor ..... 40/584
5,626,094 A * 5/1997 Jeffery et al. ..... 116/205
5,637,378 A * 6/1997 Hensler et al. ..... 428/192
5,678,337 A * 10/1997 Ashoori ..... 40/594
5,714,255 A * 2/1998 Yeh ..... 428/364
5,764,060 A * 6/1998 Gonzalez et al. ..... 324/326
5,775,016 A * 7/1998 Chien ..... 40/544
5,791,114 A * 8/1998 Mandel ..... 52/591.3
5,961,072 A * 10/1999 Bodle ..... 244/118.5
6,025,773 A * 2/2000 Bresnan ..... 340/407.1
6,082,886 A * 7/2000 Stanford ..... 362/576
6,176,450 B1 * 1/2001 Bergman ..... 244/1 R
6,328,500 B1 * 12/2001 Rubio ..... 404/32
6,576,074 B1 * 6/2003 Cabrera et al. ..... 156/71
6,783,829 B2 * 8/2004 Arena ..... 428/40.1
7,182,040 B2 * 2/2007 Pharo et al. ..... 116/200
7,188,582 B2 * 3/2007 Pharo et al. ..... 116/200
2003/0152744 A1 * 8/2003 Arena ..... 428/98
2004/0013848 A1 * 1/2004 Kobayashi et al. ..... 428/85
2005/0016105 A1 * 1/2005 Wagner ..... 52/506.01

* cited by examiner

PERSONNEL LOCATION CONTROL SYSTEM WITH INFORMATIONAL MESSAGE PRESENTATION

RELATED APPLICATIONS

This application is a continuation of my U.S. patent application Ser. No. 10/635,871 filed Aug. 5, 2003, for Personnel Location Control System with Message Presentation, which is, in turn, a continuation of my U.S. patent application Ser. No. 10/056,714 filed Oct. 24, 2001, which is, in turn a continuation of and based on my co-pending U.S. patent application Ser. No. 09/307,104, filed May 6, 1999, which is, in turn, based on and claims for priority, the filing date our U.S. Provisional Patent Application Ser. No. 60/084,591, filed May 7, 1998, for Personnel Guidance and Location Control System, and is a continuation of my U.S. patent application Ser. No. 08/741,619, filed Oct. 30, 1996, for Personnel Guidance and Location Control System.

BACKGROUND OF THE INVENTION

1. Field of the Invention

This invention relates to certain new and useful improvements in personnel waiting guidance, placement and location control systems for guiding individuals in a controlled manner and also for providing floor located informational material to one or more individuals while in that pathway or otherwise at a particular place for an activity.

2. Brief Description of the Related Art

Personnel guidance and location control systems have been used in a variety of activities for controlling a path of movement for one or more individuals to a particular activity. These guidance and location control systems usually rely upon a group of poles with guide ropes to guide a group of individuals into a standing line, where each of the individuals in that line advance progressively toward a particular activity as, for example, a teller in a bank or otherwise to a ticket counter in an airline terminal, etc.

There have also been personnel guidance and location control systems which rely upon painted lines on a floor or ground surface to define a guidance path to a particular activity.

Each of these commercially available guidance and location control systems suffer from a number of drawbacks which limit their effectiveness. In the case of the poles and flexible ropes or cables, the individual components are loosely mounted on a floor surface and are subject to vandalism and theft. Secondly, they can be readily moved by the individuals for either enhancing the position of such individuals in a line of waiting individuals, or because of sheer nuisance purposes. Moreover, when these temporary personnel guidance and location control systems are located in an exterior environment, they must be periodically removed and stored to prevent further theft or vandalism as, for example, when an activity has closed.

Painted markers suffer a number of problems, such as the erosion and the wearing away, as previously described. Moreover, there are many ground surfaces in which it is virtually impossible to paint a straight line or other guide forming line. For this purpose, tapes have been applied to ground surfaces in order to produce a guide path. However, the tapes rub off or, again, after a period of time, loose their adhesiveness for securement to the ground surface.

In my aforesaid co-pending patent applications, there are set forth various guidance and location control systems which meet and, at least, partially overcome some of the previously described problems. However, these presently available personnel guidance, placement and location control systems do not provide any informational material at a floor level to the one or more individuals who may be walking or standing in that guide path. It has been recognized that while waiting in a line of individuals or in a guide path to reach a particular activity, the people standing are particularly amenable to reading or observing material which will at least occupy a portion of the time while waiting to reach or achieve a particular activity. There has been no commercially available or even proposed system which provides for the interchangeability of informational bearing substrates in a floor covering and which allows for an occupant in that pathway or at a particular location to observe that material. Moreover, it is important to constantly change that material, as, for example, from day to day, so that the user of the guidance and location control system will not become bored by a single message which seemingly never changes.

There have been individual placemats or, for that matter, floor coverings which bear information as, for example, placemats at soft drink dispensers identifying the location for obtaining a soft drink or otherwise containing promotional or advertising material. As a simple example, a particular placemat or floor covering in front of a drink dispenser could read "Drink Crush Cola". However, in all such cases, the information bearing material is permanently provided and, if there was any need or desire to change the message or, for that matter, the graphic material surrounding the message, it would be necessary to use or install a new placemat. In like manner, carpet sections have been located at the entrance to various institutions as, for example, a carpet section bearing a hotel's name at the entrance to that hotel. However, and here again, the information in that carpet section is permanently incorporated in the mat and cannot be changed.

It would be desirable to provide a personnel location control system which not only provides cuing information to the individual for instructing placement of the individual at a particular location, but to also provide readily changeable informational bearing material on the floor surface. It would also be desirable to provide a personnel location control system which also functions as a guidance system for guiding a group of individuals in a selected pathway and also providing readily changeable informational bearing material thereon.

OBJECTS OF THE INVENTION

It is, therefore, one of the primary objects of the present invention to provide a personnel location control system in which a ground covering material can be removably located on a ground surface and which may define either a guidance pathway or a location for a particular activity, or both.

It is another object of the present invention to provide a personnel guidance, placement and location control system of the type stated in which guide path forming elements can be altered for easily and quickly altering a guide path.

It is a further object of the present invention to provide a personnel guidance, placement and location control system of the type stated in which individual floor covering segments can be substituted for one another in order to form a desired guide path or otherwise to form a particular location for standing at a certain activity.

It is an additional object of the present invention to provide a personnel guidance, placement and location control system of the type stated in which a plurality of ground covering segments may be used and connected together in various desired patterns.

It is also an object of the present invention to provide a personnel guidance, placement and location control system of the type stated in which informational bearing material at a floor level on floor covering material can be easily and readily changed without the necessity of materially changing the floor covering material.

It is still another object of the present invention to provide a personnel location control system of the type stated in which instructional material can be imparted to one or more users in a guide path or otherwise at a particular activity, or otherwise in which promotional and advertising material may be presented and which is capable of being rapidly and readily changed without the necessity of removing an entire floor covering material.

It is still a further objection of the present invention to provide a method of altering information bearing materials on a floor covering both rapidly and inexpensively and in such manner that the information is either effectively used or highly pleasing to the observer.

With the above and other objects in view, our invention resides in the novel features of form, construction, arrangement and combination of parts and components presently described and pointed out in the claims.

BRIEF SUMMARY OF THE INVENTION

A personnel location control system for controlling movement of pedestrian individuals using floor covering materials, and for also providing readily changeable information on said floor covering materials. The invention also relates to a personnel guidance and location control system for forming a guide path in which to move a group of pedestrian individuals in an orderly and controlled fashion to a particular activity or destination.

In one embodiment of the invention, the location control system may rely upon a single floor covering substrate to identify a particular location in which an activity may occur. In another embodiment of the invention, the location control system may rely upon a plurality of floor covering segments which are arranged in a particular desired configuration to define a path of movement for a group of individuals. In this way, the location control system becomes a personnel guidance and location control system.

The location control system of the present invention may also rely upon a plurality of markers which define a guide pathway. These markers may be small, discrete markers or elements and they may also be used in conjunction with any elongate or similar marker which identifies a head of a line position. In this way, the one or more individuals will be guided in a particular guide path to a front end of head of a line position and which then leads to a particular activity.

While the present invention may be operable with a location control system or otherwise a personnel guidance and location control system, this invention also provides an informational bearing material at a floor level for providing instructional material to a user. This informational material preferably is provided on or in one or more of the ground covering substrates. Thus, the informational material may be presented at a particular standing location or in a guided pathway. It may also otherwise present marketing or promotional material to a user in that standing location or in a particular guidance path. In this particular case, the present invention relies upon information bearing substrates which can be readily interchanged and replaced without the necessity of substantially altering or removing a floor covering material. Various means for achieving this changeability of information bearing substrates is hereinafter described.

The formation of guide paths for one or more individuals to reach a head of a line position is described in the aforesaid co-pending U.S. patent application Ser. No. 08/741,619, dated Oct. 30, 1996, and also in a co-pending continuation-in-part U.S. patent application Ser. No. 10/004213, filed contemporaneously herewith, for Personnel Guidance and Location Control System. Accordingly, the actual formation of a guidance pathway is not described in detail herein, except to the extent necessary for its applicability in the present invention. Nevertheless, to the extent that material from that aforesaid co-pending patent applications are not physically incorporated herein, such material is incorporated herein by reference.

In one embodiment of the invention the guidance and location control system comprises an elongate element and a plurality of small discrete elements which are capable of being secured to a carpet or other floor material in fixed locations where the small discrete elements are fixed and relative to the elongate element in a desired arrangement to define a desired guide path. This arrangement would typically define a pathway for controlling the movement of a group of people to an end of the line designation therefor.

The guidance location and control system in that aforesaid co-pending patent application is highly effective and is uniquely capable of being arranged in a variety of patterns. Thus, there is, in effect, no limitation to the individual patterns which can be achieved. In accordance with this system, the pattern which is desired, including the pathway for controlling the movement of a group of people, as well as the end of line position, can all be pre-formed on this ground cover substrate, which is then disposed on or secured to a ground surface.

The discrete elements and the elongate element can all be secured, for example, to a piece of carpet material which is laid over a ground surface. This carpet material, in one embodiment, could have the discrete elements and the elongate element secured by means of fasteners on the underside of each of these elements. Nevertheless, when secured to the ground cover, such as the carpet in a desired location, installation is very quick and simple, in that the ground cover substrate is then secured to a ground surface.

In another embodiment of the invention, the discrete elements and the elongate element are integrally formed into the carpet material. During the weaving process, the carpet itself may be formed of a e.g. gray colored material. However, the weaving apparatus would be pre-programmed to incorporate white areas representing the white discrete elements and elongate element. Thus, when the carpet is woven, these discrete elements and the elongate element, with the latter representing the end of the line position, would all be integral in a carpet material substrate. When the ground cover is a sheet of vinyl, the vinyl can be pre-printed with the desired pattern.

In another embodiment of the invention, holes could be formed in a carpet sheet representing a ground cover substrate and plugs of different colored carpet material would be inserted in those holes. Thus, an elongate hole having the shape of the elongate element would receive an elongate element formed of the same material but of a different color than the carpet substrate. The same holds true for the small discrete elements.

In yet another embodiment of the invention, the ground cover substrates can be provided as modular substrates. In accordance with this embodiment of the invention, a plurality of ground cover substrates are provided and with certain of the ground cover substrates having different guidance patterns of discrete elements than others of the ground cover substrates. Thus, one of the substrates will have an elongate element formed thereon as a head of a line position and few of the discrete elements thereon to represent the beginning of the pathway for a group of individuals. Another ground cover substrate could have the individual discrete elements formed thereon in a linear row. Still another ground cover substrate could have the small discrete elements formed thereon in a arcuate pattern to represent a turn in the pathway. Any of a number of patterns could be pre-formed on other ground segments.

When a user of the system desires to set up its own guidance location and control system, the user would select the desired patterns, such that the user could assemble the ground cover substrates in a desired arrangement to obtain that pathway desired by the user.

The informational material which is incorporated in the ground covering substrates may adopt a variety of forms. Thus, for example, the informational material may be advertising or promotional material. With respect to this material, it is important to frequently change this material, so as to avoid boredom to those pedestrians who will frequently use a particular locational control system. In addition, the informational material may adopt a form of information to users in various institutions about which activities are occurring in a particular line. As an example, in a post office, the informational message in the substrate can be changed periodically so as to represent for one day, an express mail line, and on another day, a purchase postage only line, etc. It is not necessary to change the substrate, but merely the informational material carried thereby.

It is also possible to use a single individual substrate which does not identify a pathway. With the informational substrate, this is highly effective for promoting particular articles. For example, a mat may be located at a drink dispenser, and on one day, the mat may contain a message about a particular manufacturer's soft drink, and on another day, it may contain another message about another manufacturer's soft drink.

The informational display may be inserted into a pocket formed in a substrate, having a closable, transparent upper flap. Moreover, the substrate may be provided with a depression therein in order to receive the informational bearing material, and which is again covered by a transparent outer sheet. Further, foam material can be incorporated in the region of the informational bearing substrate so as to highlight the particular message contained thereon. In addition, it is possible to provide electrical lights to further enhance an informational bearing material.

This invention has many other advantages and purposes which will become more fully apparent from the following detailed description and the accompanying drawings which illustrate one of the preferred embodiments of the personnel waiting control system. However, it is to be understood that this following detailed description and the accompanying drawings are set forth only for purposes of illustrating and describing the general principles of the invention and are not to be taken in a limiting sense.

BRIEF DESCRIPTION OF THE DRAWINGS

Figure 1:
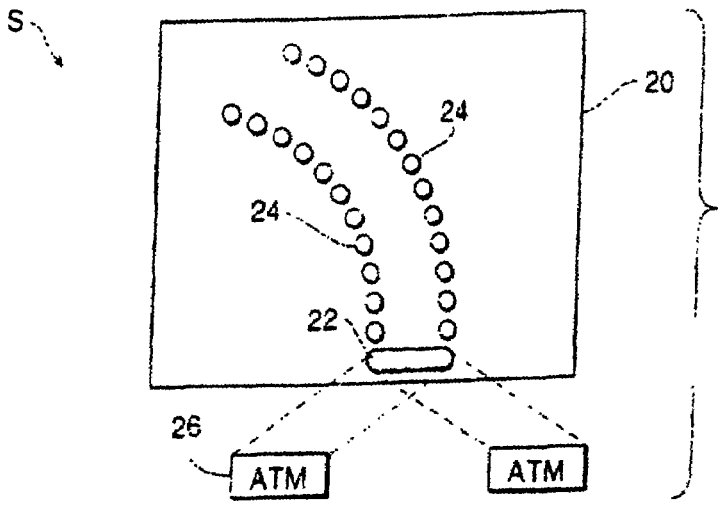
Figure 2:
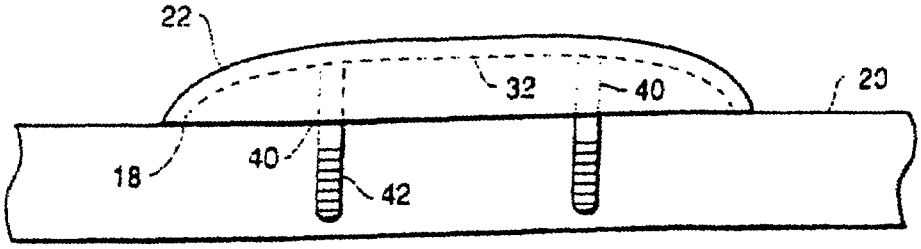
Figure 3:
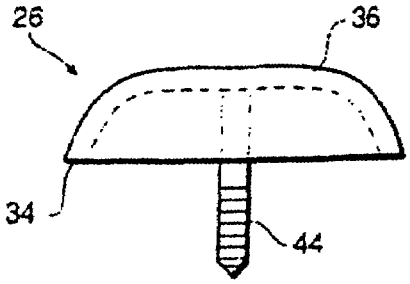
Figure 4:
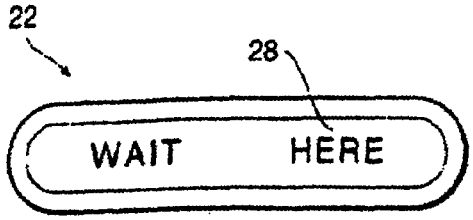
Figure 5:
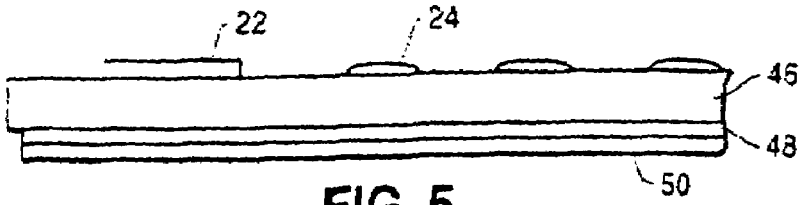
Figure 6:
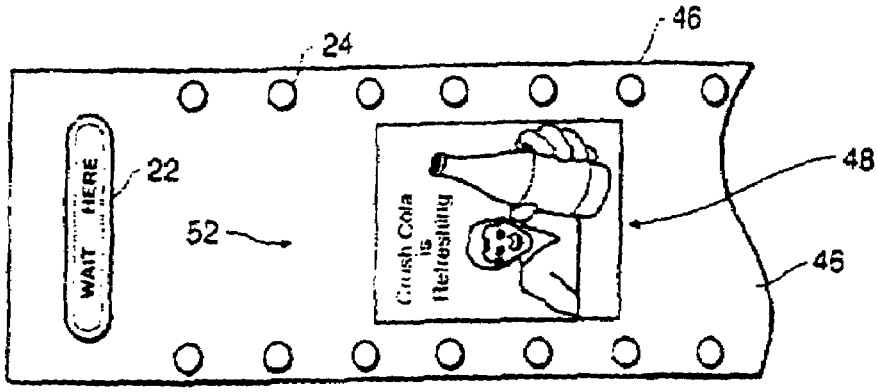
Figure 7:
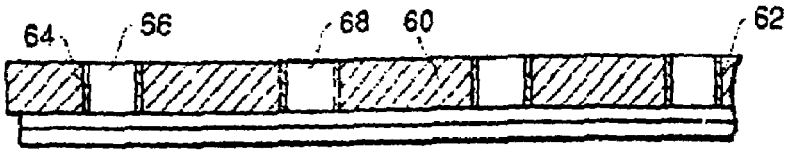
Figure 8:
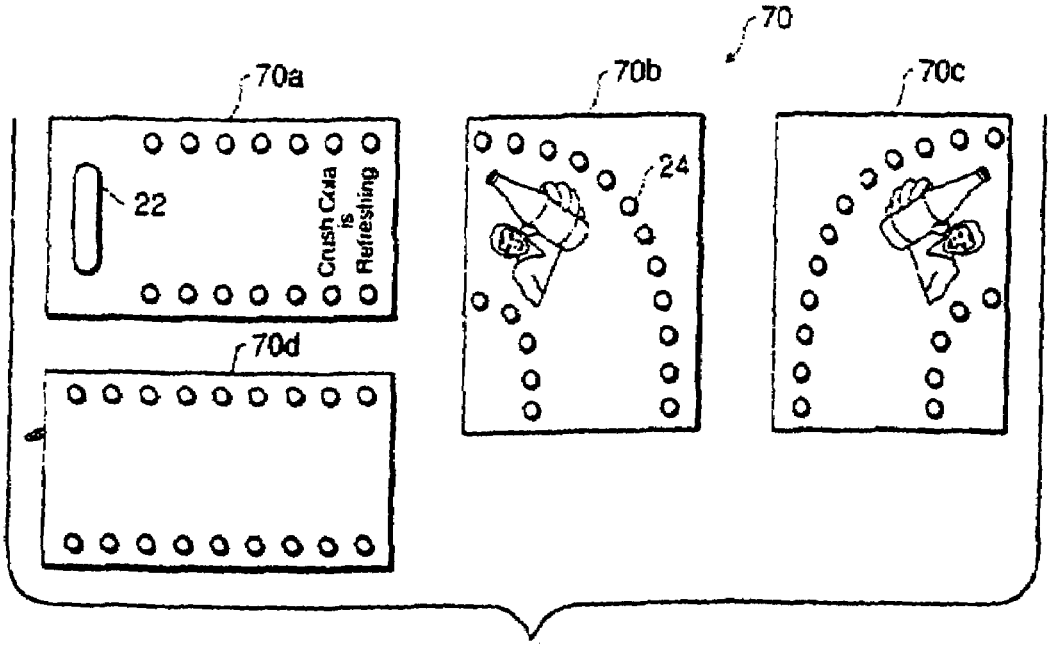
Figure 9:
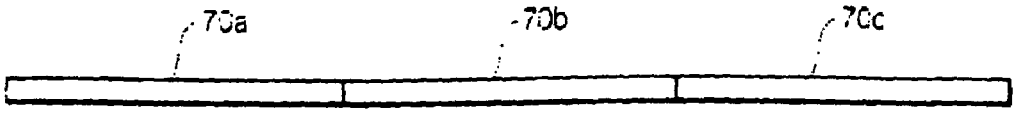
Figure 10:
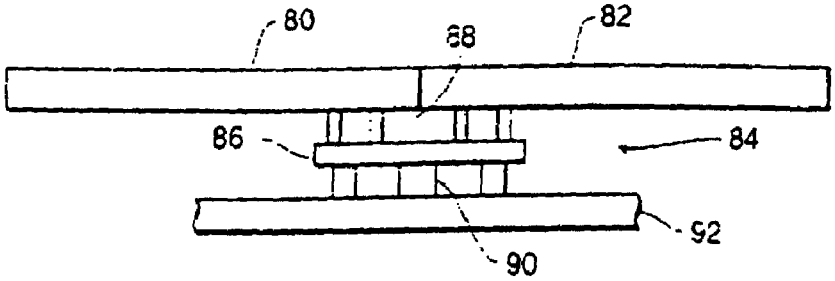
Figure 11:
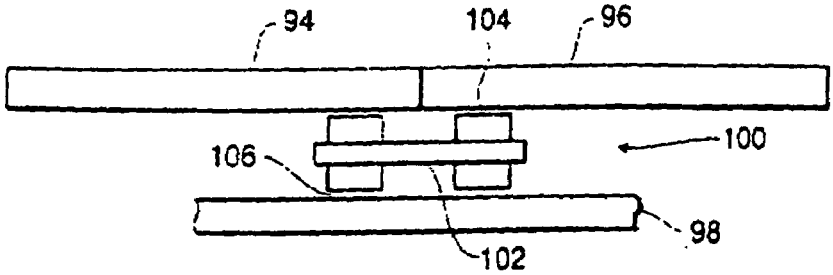
Figure 12:
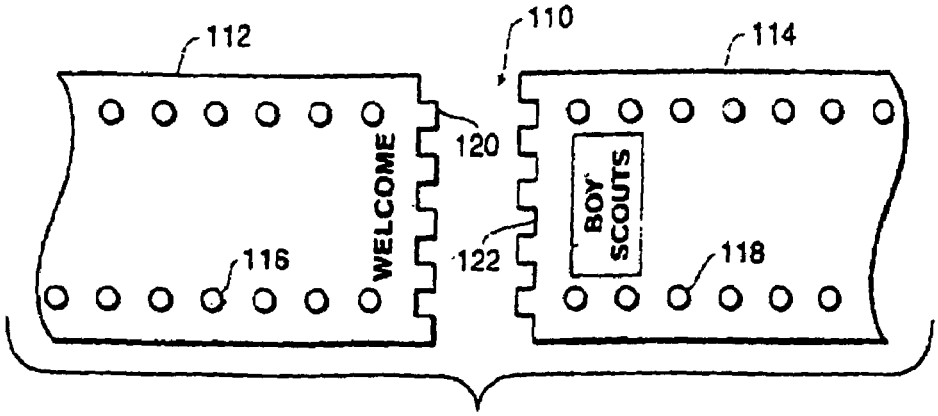
Figure 13:
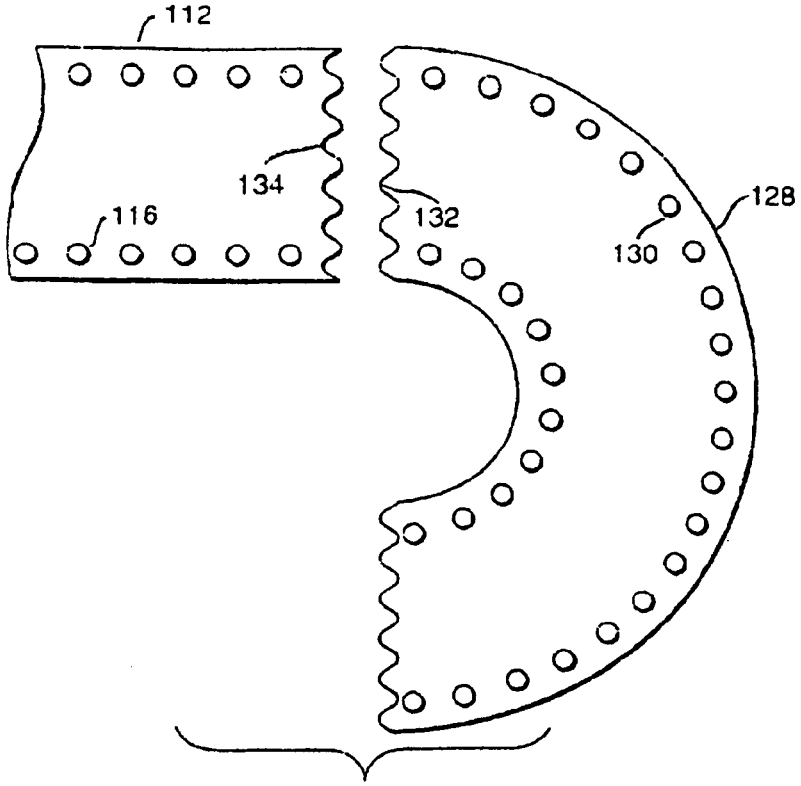
Figure 14:
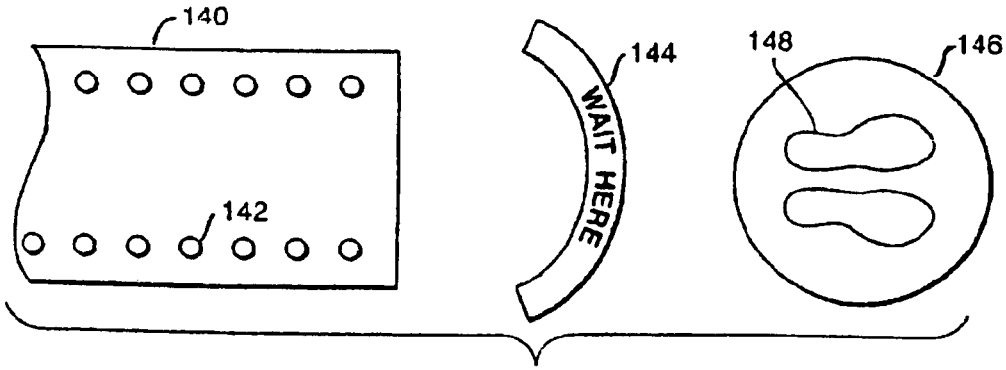
Figure 15:
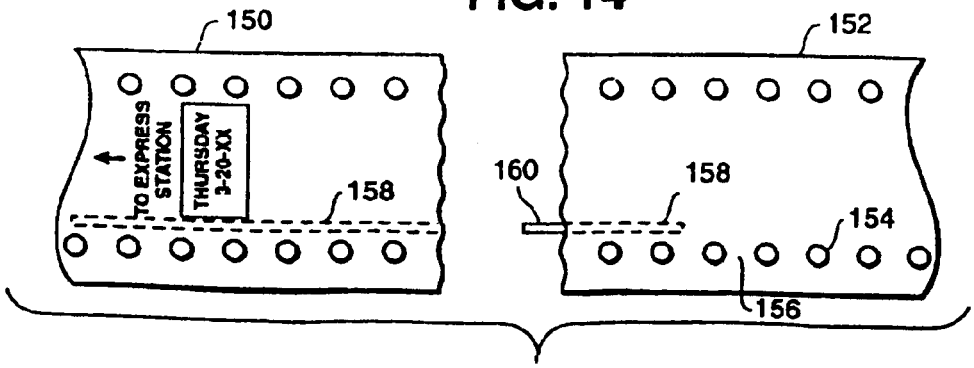
Figure 16:
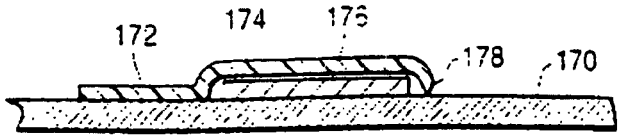
Figure 17:
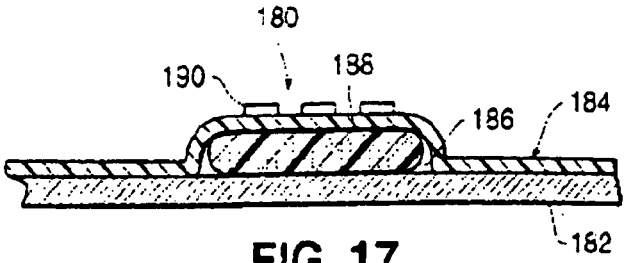
Figure 18:
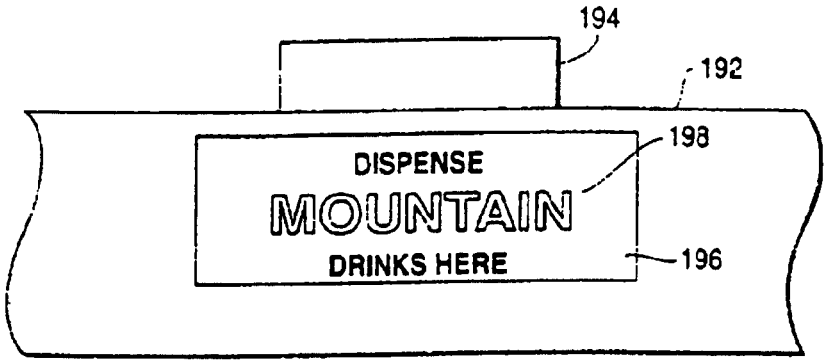
Figure 19:
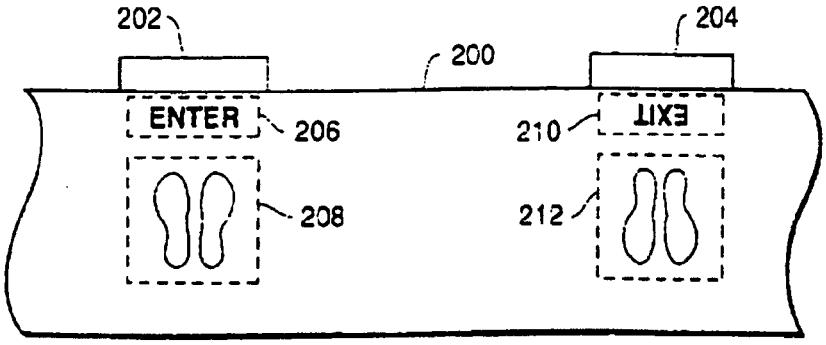
Figure 20:
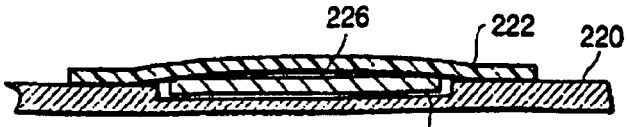
Figure 21:
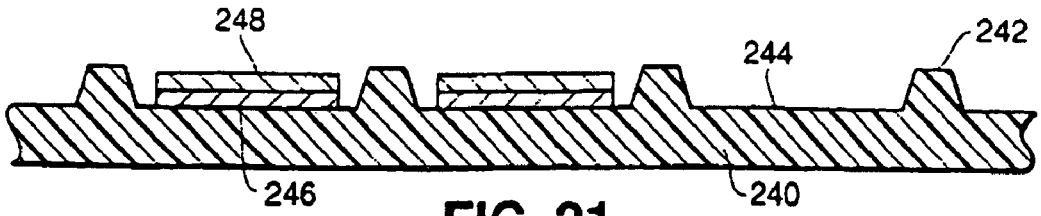
Figure 22:
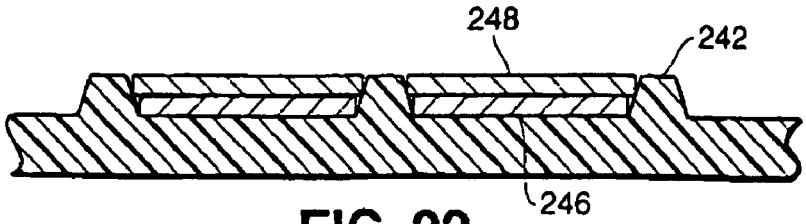
Figure 23:
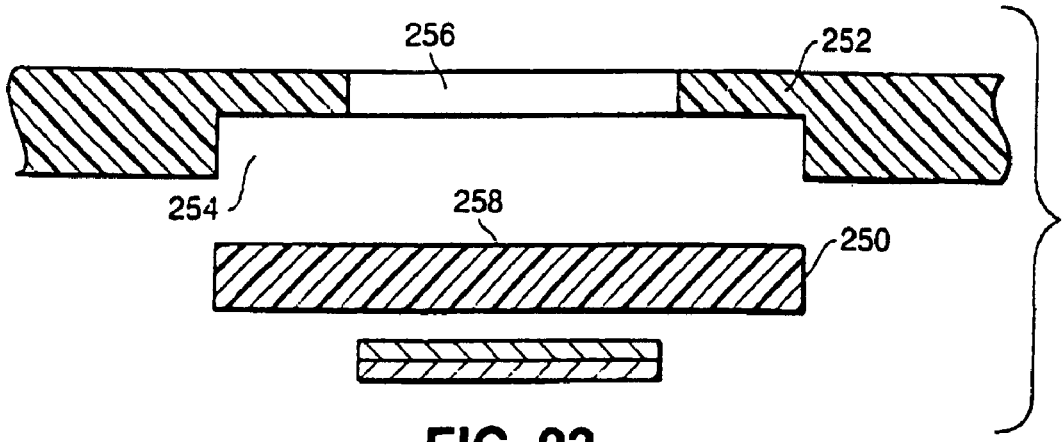
Figure 24:
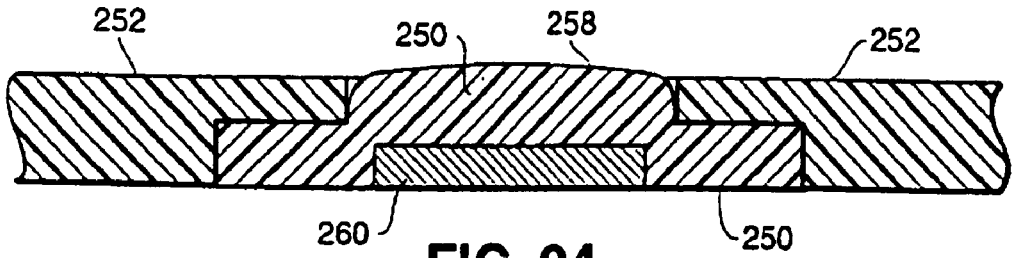

Having thus described the invention in general terms, reference will now be made to the accompanying drawings in which:

FIG. 1 is a top plan view showing one embodiment of the personnel waiting guidance and control system constructed in accordance with and embodying the present invention;

FIG. 2 is a fragmentary side elevational view, partially in section, of the elongate element mounted on a substrate and forming part of the control system of the present invention;

FIG. 3 is a side elevational view of one form of discrete small guide path defining element forming part of the personnel control system of the present invention;

FIG. 4 is a top plan view of the one form of the elongate end of the line element forming part of the personnel system of the present invention;

FIG. 5 is a fragmentary side elevational view of one form of ground cover substrate forming part of a personnel guidance and location control system of the present invention;

FIG. 6 is a top plan view of one form of ground cover substrate forming part of the personnel guidance and location control system of the present invention;

FIG. 7 is a fragmentary sectional view showing another embodiment of a ground cover substrate forming part of the personnel control system of the present invention;

FIG. 8 is a composite of individual ground cover substrates in modular form which can be arranged in a desired combination to form a guidance and location control system in accordance with the present invention;

FIG. 9 is a side elevational view showing an arrangement of ground cover substrates connected together;

FIG. 10 is a fragmentary side elevational view showing one means for securing ground cover substrates to a carpeted ground surface;

FIG. 11 is a fragmentary side elevational view showing another means for securing ground cover substrates to a hard ground surface;

FIG. 12 is a fragmentary plan view of another modified form of ground cover substrates, which can be releasably connected together;

FIG. 13 is a fragmentary plan view similar to FIG. 12 and showing still other forms of ground cover substrates which can be connected together;

FIG. 14 is a plan view showing another modified form of guidance and message presenting system in which components thereof were not necessarily connected together;

FIG. 15 is a fragmentary plan view showing still a further modified form of location control system in accordance with the present invention and which uses position indicating electric lights;

FIG. 16 is a fragmentary vertical sectional view showing one form of presenting a message in a ground cover substrate;

FIG. 17 is a fragmentary vertical sectional view similar to FIG. 16, and showing another means for presenting a message in a ground cover substrate;

FIG. 18 is a fragmentary plan view showing a single position location control system providing an informational message in accordance with the present invention;

FIG. 19 is a top plan view of a modified form of personnel control system also presenting changeable messages thereon;

FIG. 20 is a fragmentary vertical sectional view of still a further modified form of presenting messages in a ground cover substrate;

FIG. 21 is a fragmentary vertical sectional view showing a modified form of providing an informational message to an upper surface of a ground covering substrate;

FIG. 22 is a fragmentary vertical sectional view, similar to FIG. 21, and showing a slightly modified form of presenting the informational messages on the upper surface of a substrate;

FIG. 23 is an exploded fragmentary vertical sectional view showing components forming part of a modified system for presenting an informational message in a ground covering substrate; and FIG. 24 is a fragmentary vertical sectional view, similar to FIG. 23, and showing the components of FIG. 23 in an assembled form.

DETAILED DESCRIPTION OF A PREFERRED EMBODIMENT

Referring now in more detail and by reference characters to the drawings which illustrate a preferred embodiment of the present invention, S designates a personnel guidance and control system comprised primarily of a ground cover substrate 20, as hereinafter described in more detail. Mounted in the substrate 20 is an elongate element or member and referred to as a "head of the line" member 22 and a group of small discrete path defining members 24.

The elongate element 22 and the path defining discrete elements 24 are preferably located on the ground cover substrate 20 in a particular arrangement to define a path of movement of a group of individuals in a waiting area so that each of the individuals may then advance to a selected activity.

In accordance with the present invention, and merely for the purposes of illustrating the present invention, the personnel waiting guidance and control system shows the location of the entire substrate 20 including the elongate element 22 and the small discrete elements 24 forming a waiting line to one or more automated teller machines 26. However, it should be understood that the use of the personnel guidance and control system in connection with the automated teller system designated as "ATM" is only for purposes of illustrating the principles of the invention and that the invention is operable with countless other activities.

The elongate element 22 may have imprinted on its upper surface, or otherwise applied to the upper surface, certain indicia 28 thereon for providing instructions to the group of individuals. As a simple example, the indicia 28 on the elongate element 22 may read "Wait Here" or "Next", or other similar words which define a location in which individuals at the head of a line are requested to wait. Thus, in the case of an automated teller machine, the individual at the head of the line will wait their turn to use the automated teller machine until completion of use by a party presently at the automated teller machine.

The holding of a line of individuals at a pre-selected distance away from the automated teller machine will also allow any security camera associated with that teller system to properly scan the line of individuals waiting to use the machine. Thus, if a security problem should arise and which can be observed by the camera system or if there is another problem in the line of individuals, that is scanned by the camera system, a potential intervening action may be taken. Thus, the control system of the invention provides an added degree of security.

In the embodiment of the invention as illustrated, the elongate element 22 has somewhat of an inverted dish-shaped construction and is formed on its underside with an angular downwardly facing rim 30 and a recessed bottom wall 32. This construction renders a light weight elongate element 22 without materially affecting its structural properties. Moreover, the recessed bottom wall also, in certain embodiments, allows for a convenient stacking and nesting of the elongate elements for purposes of shipping and storage.

FIG. 2 further illustrates the elongate element 22 mounted within an substrate such as the substrate 20. In this particular case, the substrate is illustrated as being formed of carpeting material. However, and as indicated, any material form can be used for this purpose.

The small discrete elements 24 forming part of the personnel guidance and control system of the invention are circular in shape, as shown in the top plan view thereof. Moreover, each of the small discrete elements 24 have recessed bottom walls, such that they form an annular downward facing rim 34 and a recessed bottom 36, all in the manner as best illustrated in FIG. 6 of the drawings. The lower edges of each of the discrete elements 24 are adapted for engagement with the ground cover substrate 20 and are located at an angle such that the sole or heel of a shoe will not catch on that lower edge and these edges will also allow wheelchairs to easily roll over the discrete elements.

In accordance with the present invention, and particularly by reference to FIG. 1, it can be seen that the elongate element 22 and the small discrete elements 24 can be located on a ground cover substrate in a desired arrangement in order to achieve a guidance path and a head of a line position for a group of individuals. One of the important aspects of the present invention is that this personnel guidance and control system is not readily subjected to damage or theft and can be relatively fixedly secured to a ground surface, but yet removable from location in another location.

In one embodiment of the present invention, the elongate element 22 is provided with a plurality (a pair as shown) of spaced apart screws 40 which may be inserted into a ground cover substrate, such as a carpeted ground cover substrate. Moreover, these screws 40 allow for fastening fitting within a carpet for retentive securement thereto. In this case, the screws have a fairly coarse thread 42 thereon such that the threads only allow a minimal number of turns of the screw. In this way, where the screws are used for securing the elongate element 22 to a carpet-like fabric material, they will not tear the material and only engage the pile of the carpet or rug.

It is also possible to secure the small discrete elements to a ground cover substrate, as for example, by means of an adhesive securement or otherwise by means of screws, such as the screws 44.

FIG. 3 more fully illustrates a single screw 44 molded into each of the small discrete path defining members 24. Again, this screw 44 has a large diameter thread which is relatively coarse and only permits a limited number of turns, much in the same manner as the screws 40, in the elongate element 22.

The small discrete path defining elements 24 may have an adhesive strip 46 on the downwardly presented rim thereof. Moreover, the adhesive strip 46 may be covered with a releasable and removable protective backing, if desired. In accordance with this construction, the removable backing strip can be removed for allowing the adhesive strip to become secured to a ground cover substrate.

It should be understood that the elongate element 22 could also be provided with adhesive strips on its downwardly facing rim 30. Thus, and in this way, the elongate element can be secured to a ground cover substrate much in the same manner as the small discrete elements.

As indicated previously, the present invention utilizes a ground cover substrate which is disposed on a ground surface. The ground surface may be any form, such as a ground soil surface, or otherwise it may be a manufactured surface, such as a wooden surface, a vinyl tile or ceramic tile surface or, for that matter, a wood surface. With hard covered surfaces, the ground cover substrate is frequently provided with an adhesive means and preferably a releasable adhesive means so that the ground cover substrate can be removed from the ground surface. In the case of a carpeted or rug surface, the ground cover substrate may be secured through improved carpet strips in manner as hereinafter described.

In the present invention, each of the elongate elements 22 and the small discrete elements 24 can be pre-mounted on a ground cover substrate, as aforesaid. In this way, it is only necessary to apply the ground cover substrate to a ground surface.

FIG. 5 shows an embodiment of the invention in which there is an elongate element 22, such as a head of a line element, and a plurality of discrete path-defining elements 24 starting from opposite sides of the elongate element defining a path, much in the manner as shown in FIG. 1 and, for that matter, in FIG. 6. The ground cover substrate in this embodiment may adopt the form of either a relatively rigid material, such as a vinyl tile material or the like, or it may adopt the form of a fabric material, such as a carpet. FIG. 5 illustrates a ground cover material 46, such as a relatively rigid type material, e.g. a vinyl ground covering material, having an adhesive surface 48 on its underside. The adhesive is covered by a releasable backing 50, such that when the backing 50 is removed, the adhesive 4,8 can be secured to a ground surface as, for example, another manufactured and rigid surface. The term "ground surface" is used herein to reflect any surface to which the substrate is applied and does not necessarily imply a ground soil surface.

FIG. 6 illustrates an embodiment of the invention in which there is a ground cover substrate 46 having the elongate head of the line element 22 and the individual discrete path-defining elements 24. In this particular case, the path-defining elements are located at each of the sides of the ground cover substrate 46 to form an individual pathway 48. However, it should be understood that the individual discrete elements could be located in a different arrangement, such as to form an arcuate path or the like.

In the embodiments of the invention as shown in FIGS. 5 and 6, the elongate element 22 and the individual discrete elements 24 may be integrally formed in the ground cover substrate 46 in any of a variety of fashions. As indicated previously, the elongate element 22 and the discrete path-forming elements 24 may be woven into a carpet ground cover substrate. Otherwise, if the ground cover substrate is relatively hard material, such as a vinyl, they can be pre-printed onto the vinyl. Further, they can be painted onto the ground cover substrate, or otherwise applied. In all cases, the individual ground cover substrates 46 can then be taken to a site of use and readily and easily applied to the ground surface as, for example, through an adhesive layer 48 in connection with the embodiment of FIG. 5. In like manner, screws may also be provided on the underside of the ground cover substrate 46 for securement to a relatively rigid ground cover surface. Other means for releasably securing the ground cover substrates to the ground surface may be used. In addition, these various segments may merely be laid upon the ground surface.

Further, in the embodiment as shown in FIG. 6, there is an informational presentation 52, which in this case is a type of advertising or promotional material. The exact form in which this informational presentation is made in the substrate 46 is hereinafter described in more detail. However, the entire message presentation is set forth in one substrate.

FIG. 7 illustrates an embodiment of the invention in which there is a carpet material ground cover substrate 60. The carpet substrate 60 is provided with a plurality of openings 62 for the individual discrete elements and an enlarged opening 64 for the elongate element 22. In this particular case, a plug 66 having the size of an elongate element, but of a different color than the carpet 60, is inserted in the enlarged opening 64. In each of the other openings 62 there are provided plugs 68 representing the small discrete path-defining elements. These plugs 68 would also have a different colored surface than the carpet substrate 60. In addition, each of the individual plugs 66 and 68 can be provided with a slightly raised surface, as shown in FIG. 7, if desired.

In another embodiment of the invention, modular ground cover substrates 70 could be provided, as shown in FIG. 8. There is a first substrate 70*a* which has an elongate element 22 formed on the surface thereof or incorporated in the material thereof. A second carpet substrate 70*b* has a plurality of small discrete elements 24 located in somewhat of an arcuate path and thereafter leading into a straight or linear path. In this way, by combining the substrates 70*a* and 70*b*, one could form the start of a personnel guidance path which then has an arcuate turn in approximately a 90° direction. By adding a further substrate 70*c*, which also provides an arcuate turn in an opposite direction, one could further revise the guidance path. By adding a further substrate 70*d*, which also has elongate columns of small discrete elements, a linear path-defining portion would be added to the arcuate path of the substrate 70*b*.

These various substrates 70*a* through 70*d* all show various modular ground cover substrates which can be used in the invention and show a limited number of various discrete path-defining element arrangements. It should be understood, however, that these various substrates 70*a* through 70*d* are only illustrative of the numerous embodiments of the invention would could be obtained. Thus, rectangularly shaped corner portions could be provided and arcuate corner portions with very small or very large angles could also be provided. In addition, various other designs could be provided on a substrate for insertion between two other substrates defining a pathway to add some variation in design to the pathway.

In the embodiment of the invention as shown in FIG. 8, a portion of an informational message is set forth in the first ground covering substrate 70*a*, and a remaining portion of that message is set forth in the ground covering substrate 70*b*. In this way, when the two substrates are abutted or otherwise connected together, they will form a complete informational message. Thus, and in the embodiment as shown, a word message can be set forth in one substrate and a pictorial message can be set forth in another abutting or adjacent substrate.

In accordance with the present invention, a user can obtain a plurality of individual modular substrates and arrange these substrates in a pattern which suits the particular user. Thus, for example, the user could abut three ground cover substrates, such as, for example, the ground cover substrates 70*a*, 70*b* and 70*c* together in a manner as shown in FIG. 9. These ground cover substrates could be merely laid upon a ground surface or otherwise secured to the ground surface.

In the case where the ground cover substrates are formed of a carpeted material, the ground cover substrates, such as substrates 80 and 82, may be secured to another carpeted ground surface by means of specially designed carpet strips 84, as shown in FIG. 10. Each carpet strip 84 comprises a small flat metal substrate 86 which has nails or similar pointed prongs 88 on the upper surface for insertion into the carpet substrates 80 and 82 and nails 90 on the undersurface for insertion into the carpeted ground surface 92. In this way, the strips 84 hold the two ground cover substrates 80 and 82 in an abutted position on a carpeted ground surface 92.

FIG. 11 illustrates an embodiment where two relatively rigid ground cover substrates 94 and 96 are abutted against one another to form a desired pattern on the upper surface. These two ground cover substrates 94 and 96 are, in turn, secured to a relatively rigid ground cover, such as a ceramic tile surface 98, by means of fastener strips 100. In this case, the fastener strips 100 also may have a metal substrate or other hard substrate 102, along with adhesive surfaces 104 on the upper portion thereof and adhesive surfaces 106 for securement to the ground surface 98.

It should be understood that the fastener mechanisms for securing the various ground cover substrates to the ground surface are only illustrative of a large number of mechanisms which could be employed for this purpose. Thus, fiber fastening strips and the like could be used.

It should be recognized that indicia could be incorporated on the small discrete path-forming elements, such as the elongate element. For example, arrows could be formed on one or more of the small discrete path-defining elements. In this way, the arrows or means of specially designed carpet strips 84, as shown in FIG. 10. Each carpet strip 84 comprises a small flat metal substrate 86 which has nails or similar pointed prongs 88 on the upper surface for insertion into the carpet substrates 80 and 82 and nails 90 on the undersurface for insertion into the carpeted ground surface 92. In this way, the strips 84 hold the two ground cover substrates 80 and 82 in an abutted position on a carpeted ground surface 92.

FIG. 11 illustrates an embodiment where two relatively rigid ground cover substrates 94 and 96 are abutted against one another to form a desired pattern on the upper surface. These two ground cover substrates 94 and 96 are, in turn, secured to a relatively rigid ground cover, such as a ceramic tile surface 98, by means of fastener strips 100. In this case, the fastener strips 100 also may have a metal substrate or other hard substrate 102, along with adhesive surfaces 104 on the upper portion thereof and adhesive surfaces 106 for securement to the ground surface 98.

It should be understood that the fastener mechanisms for securing the various ground cover substrates to the ground surface are only illustrative of a large number of mechanisms which could be employed for this purpose. Thus, fiber fastening strips and the like could be used.

It should be recognized that indicia could be incorporated on the small discrete path-forming elements, such as the elongate element. For example, arrows could be formed on one or more of the small discrete path-defining elements. In this way, the arrows or other indicia literally co-act with the small discrete elements in defining a path. It should also be understood that the discrete path-defining elements could have other shapes, as opposed to a circular shape as shown. Thus, the small discrete path-defining elements 24 may have the shape of an arrow. In addition, the small discrete path-defining elements and the elongate head of the line element may all have light emitting diodes for lighting the path which is formed. Moreover, these diodes could remain in a permanently lit condition or they could be energized sequentially, as hereinafter described.

It is also possible to provide interlocking means for releasably connecting each of the substrate sections together in a desired guide forming path. FIG. 12 illustrates one such interlocking arrangement 110 on a pair of linearly located substrate sections 112 and 114, which each have small discrete guide path forming elements 116 and 118 on their upper surfaces. In this particular case it can be observed that the interlocking arrangement 110 comprises teeth 120 on one of the substrate sections and mating interlocking teeth 122 on the other of the substrate sections 114.

It is also possible to provide substrate sections which are not necessarily linear, as shown in FIG. 13. For example, FIG. 13 shows a substrate section 112, similar to that previously described, and an arcuately shaped substrate section 128, also having small discrete path forming elements 130 on its upper surface. Other shapes of substrate sections could also be employed, such as the U-shaped substrate section 128 illustrated in FIG. 15, and which also has the small discrete path forming elements 130 on its upper surface.

In the embodiment of the invention as shown in FIG. 13, there is also a modified form of interconnecting means which includes a somewhat serrated edge 132 on the arcuate substrate section 124 and a mating and corresponding serrated edge 134 on the generally linear substrate section 112. It should be understood that any form of interlocking means could be used.

It is not always necessary to actually physically abut the individual substrate sections forming a guide path or to interlock same. For example, the individual pieces forming a guide path could also be used in a spaced apart relationship with sizes, shapes and locations which identify a particular guide path. For example, with a group of individuals who are to be processed as, for example, by having photographs taken, a linear substrate section 140 may be provided with the discrete path forming elements 142 on each of the opposite edges thereof. This linear section 140 thereby defines a particular guide path for a group of individuals.

In place of having a head of line position, an individual arcuate section 144 is spaced from the right-hand end of the linear substrate section 140, as shown in FIG. 14. This arcuate section could represent, for example, a next in line position to reach a destination 146. The arcuate section could be replaced by an arrow or the like, as well. The destination 146 is the activity reached by the party at the very head of the line to have the activity occur. Thus, for motor vehicle registration, where photographs are employed, the destination 146 may be a specified area of substrate section and may even have an imprint of shoes 148 on its upper surface to identify a location where that individual would stand during the taking of a photograph.

FIG. 15 illustrates an embodiment of the invention utilizing a pair of substrate sections 150 and 152 which, in this particular embodiment, are as linear substrate sections. However, they may be arcuate substrate sections, U-shaped sections, or any other shape of substrate section. Furthermore, and in this embodiment, the individual path forming elements are rows of light emitting diodes 154 and 156 adjacent the longitudinal edges thereof. In this respect, the light emitting diodes function as the small discrete path forming elements previously described.

In order to provide electrical current to these light emitting diodes, and particularly where the substrate sections 150 and 152 are carpet sections, electrical conductors 158 can be extended through the individual carpet sections, as shown. These electrical conductors would be connected to the individual light emitting diodes by branches (not shown). Moreover, in order to connect the abutting or interlocking ends of each of the substrate sections 150 and 152, one of the substrate sections is provided with an outwardly struck tab or prong 160 adapted to fit within a socket 162 formed in a conductor 158, in the manner as best shown in FIG. 17. It should be understood that any other type of electrical light pattern could also be employed using the electrical conductors as shown in the substrate sections of FIG. 15.

FIGS. 16 through 20 illustrate various embodiments of the invention more fully directed to the informational display sections incorporated in the various substrate section forming part of the invention. As indicated previously, it is possible to use a single stationary substrate which does not necessarily form a guide path, but rather identifies a particular control location for which a user may stand in order to accomplish a particular activity. Thus, for example, a certain location may be identified for purposes of taking a picture, dispensing a beverage, operating an ATM unit, etc. Nevertheless, it is important in connection with the present invention to provide an informational display which will attract the attention of the user, whether or not that informational display is for pure information purposes or otherwise advertising and promotional purposes.

FIG. 16 illustrates a substrate 170 with a transparent plastic cover piece 172 fixedly secured to an upper surface thereof, and forming a pocket 174 for receiving an informational material substrate 176. The pocket-forming cover piece 172 is also provided with an open end covered by a flap 178, thereby allowing separation of the flap 178 from the substrate 170 in order to obtain access to the pocket 174. In this way, the informational bearing substrate 176 can be removed and a new sheet inserted in its place.

FIG. 17 illustrates a modified form of display presentation section 180 on a ground covering substrate section 182. This display section 180 includes an outer cover strip 184 forming a pocket 186 between the under surface of the cover strip 184, and the substrate section 182. A sponge foam like material plug 188 is located in the pocket 186, and provides somewhat of a pillow-type effect the display section 180. Thus, this display section 180 is raised relative to the remaining portion of the ground covering substrate 182.

Imprinted on the upper surface of the display section 180 in the region above the sponge foam core 188 is printed information material 190. Moreover, this information bearing material 190 may be embossed on the upper surface, and raised slightly with respect to the upper surface to thereby enhance the appearance of the message. In this particular case, the cover sheet 184 can be removed and replaced without necessarily requiring complete removal of the entire substrate section 182.

FIG. 18 illustrates an embodiment in which there is a substrate section 192, located at a dispenser 194, such as a dispenser of soft drinks. In this case, mounted within a recess formed in the substrate section 192, is an information bearing substrate 196, which may contain a message 198 on the upper surface thereof. In this particular case, the substrate section can say "Dispense Mountain Cola Here" on one day, and on another day, the "Mountain" portion could be removed, and another brand name producer of a cola could be inserted in its place. Otherwise, the entire information bearing section 196 can be removed. In this way, there is a convenient interchangeability of advertising or promotional material allowing numerous producers of products and services to offer their services to individuals standing at a particular activity or waiting to reach a particular activity.

FIG. 19 illustrates an embodiment of an invention in which there is a single floor mat 200 in front of an entrance door 202, and an exit door 204 leading into, e.g., a hotel lobby or the like. If it is desired to change the entrance and exit arrangements, an entrance sign 206 along with a illustration of a pair of feet 208 can be removed from the mat 200. The same holds true with an exit sign 210 and a pair of feet 212, pointed in the opposite direction showing an exit from this hotel or lobby or other location. Thus, merely by removing the individual sections, it is possible to change the directions of exit and entry, or otherwise, it is possible to put signs "No Admission", etc.

FIG. 20 further illustrates an embodiment of the invention, in which there is a floor covering substrate section 220 covered by a transparent cover piece 222. The ground cover substrate section 220 is provided with a depression forming a recess 224 to receive an information bearing sheet 226, and which has information on its upper surface. The cover sheet 222 is removable as, for example, by means of fiber fastening attachment strips, and re-securable to the upper surface of the substrate section 220, thereby allowing interchangeability of information sheets 226.

It should also be recognized that it is possible to use a flat screen display. For example, returning to FIG. 20, the information bearing sheet 226 could easily be replaced by a plasma-operated screen. In this particular case, the cover section 222 would be formed of a rigid material so that one walking on the substrate section 220 would not damage the flat panel display screen 226.

FIG. 21 illustrates an embodiment of the invention in which there is a ground covering substrate 240, typically in the form of a rubber or vinyl plastic material, and having a plurality of upstanding ribs 242 on its upper surface. In order to present an informational display, recesses 244 formed between each of the ribs are sized to receive an adhesive strip 246 and which is provided with an adhesive, both on its lower surface and on its upper surface, so as to be able to stick to the substrate 240 and to hold an informational message bearing section 248. Thus, by using the adhesive strip 246 with an adhesive coating on each of the opposite surfaces, it is possible to remove the informational bearing message 248 and substitute another informational bearing message therefor.

FIG. 22 discloses an arrangement similar to FIG. 21, except that in this particular case, the adhesive 246 extends for the full dimension between each of the ribs 242, whereas in the original embodiment of FIG. 21, the adhesive strips 246 extended only a portion of the distance between the ribs 242. In like manner, in connection with the embodiment of FIG. 22, the informational bearing section 248 also extends the full distance between each of the ribs. Moreover, the informational bearing section 248 can be flush with the upper surface of the ribs, or it can be below the surface of the upper edge of the ribs 242.

The embodiment of FIGS. 21 and 22 is highly effective where the informational bearing materials may also be in the form of the small discrete elements. In this way, it is possible to change either the discrete elements or the informational bearing message. Typically, for arrows and like directional markers, this type of arrangement has proved to be highly effective.

FIG. 23 illustrates an embodiment of the invention in which larger informational bearing substrates 250 can be used. A ground covering substrate 252 is provided and is formed with a recess 254 on its underside having an upper opening 256. The informational message bearing section 250 has a message 258 on its upper surface. It can be seen by reference to FIG. 23 that this section 250 fits within the recess 254. Moreover, the message 258 is exposed for viewing through the viewing opening 256 formed in the substrate 252. In order to provide a raised effect to the message 258, an insert piece 260 is also provided and forces the upper surface of the information bearing section 250 upwardly so that the message 258 actually lies above the upper surface of the ground covering substrate 252. Moreover, the bottom surface of the insert piece 260 will thereupon lie flush with the underside of the information bearing section 250.

It should be understood that the various means for removably mounting informational bearing messages on a ground covering substrate is only illustrative in connection with the present invention. Numerous other means for accomplishing this end could also be provided in accordance with and embodied by the present invention.

It is also possible to use enhancements to the small discrete elements. Thus, in order to enhance a promotional add for a soft drink, one could use bottle cap designs as the small discrete elements. In like manner, in order to enhance an advertisement of, e.g. cookies, the small discrete elements could be designed as a cookie.

Thus, there has been illustrated and described a unique and novel personnel location control system which meets and fulfills all of the objects and advantages which have been sought. It should be understood that many changes, modifications, variations and other uses and applications will be become apparent to those skilled in the art after considering this specification and the accompanying drawings. Therefore, any and all such changes, modifications, variations and other uses and applications which do not depart the spirit and scope of the invention are deemed to be covered by the invention.

Having thus described the invention, what I desire to claim and secure by letters patent is:

1. A personnel guidance and location control system for guiding a group of pedestrian individuals into a group of individuals of narrow width thereof and into a relatively narrow pedestrian pathway and controlling movement thereof and to an activity beyond the end of that pathway, said guidance and location control system comprising:

a) at least one ground cover substrate for disposition on a ground surface;

b) at least one elongate end of a line element associated with said cover substrate and at a fixed location thereon;

c) a pair of spaced apart rows of a plurality of small discrete path forming elements associated with said ground cover substrate in fixed locations thereon relative to the elongate element and extending from opposite ends of the elongate element creating a pair of spaced apart pathway boundaries to define the pedestrian pathway of movement for the group of individuals;

d) said pathway having a width adapted to arrange the group of pedestrian individuals into a group of individuals of narrow width which is sufficient for queuing such individuals and cause them to move to the end of the line position and a destination in advance of the end of the line position; and e) wherein said at least one substrate having said at least one elongate element, said pair of spaced apart rows, and said width of said pathway form a means for queuing said group of pedestrian individuals into said line of individuals along said at least one substrate to said at least one elongate element.

2. The personnel guidance and location control system of claim 1 further characterized in that said small discrete path forming elements extend from regions in proximity to opposite ends of the elongate element, and are arranged at a width less than the width of a conventional passenger automobile.

3. The personnel guidance and location control system of claim 1 further characterized in that indicia is provided on the upper surface of the elongate element and wherein the indicia cooperates with the path forming elements to show a direction of movement.

4. The personnel guidance and location control system of claim 1 further characterized in that fastening means is associated with the underside of the elongate element and with the underside of the small discrete elements, and that each fastening means comprises a downwardly projecting threaded member.

5. The personnel guidance and location control system of claim 1 further characterized in that fastening means is associated with the underside of the elongate element and the small discrete elements, and that the fastening means comprises adhesive strips.

6. The personnel guidance and location control system of claim 1 further characterized in that means is associated with said elongate element and said small discrete elements for locating same with the ground cover substrate, whereby the ground cover substrate with the elongate element and small discrete path forming elements located thereon can be disposed on the ground surface and arranged in a desired orientation to conform to an existing environment so as to optimize use of pedestrian walking space in that existing environment, the small discrete path forming elements thereby presenting a desired pattern to enable the orderly and controlled movement of a group of pedestrian individuals into one or more lines of same to a destination.

7. The personal guidande and location control system of claim 1 further characterized in that:

a) said elongate element comprising wait state indicia defining said fixed location as an end of a line for queuing of such pedestrian individuals.

8. A personal guidance and location control system of claim 1 further characterized in that said system comprises:

a) a plurality of movement indicator elements on said pathway between the spaced apart pathway boundaries and being presented in such manner to suggest that the individuals in the line walk in the pedestrian pathway and to depict the direction of movement in that pathway so that the individuals move to the end of the line position, said movement indicator elements cooperating with the path forming elements to present a desired pathway and a direction of movement to an end of a line position and to a destination in advance of that end of the line position.

9. A system for controlling movement of pedestrian personnel in a facility servicing such personnel and presenting informational messages in connection therewith, said system comprising:

a) a ground cover substrate for disposition on a ground surface;

b) at least one element associated with said ground cover substrate which represents a physical standing or waiting position for a pedestrian individual for a queue of such individuals;

c) a plurality of path forming elements extending from said at least one element defining a pair of spaced apart boundaries for a pathway of movement of such pedestrian individuals, said pathway having a width to arrange the pedestrian individuals into a group of such individuals and which group is of very limited width, and which ground cover substrate is positionable in a location in which movement of the pedestrian individuals is to be controlled in an orderly and organized manner;

d) a first advertising or promotional informational message presented at an upper relatively flat surface of said substrate in such manner that it is relatively interchangeable at will so that a second advertising or promotional or informational message may be readily and quickly interchanged and presented at said surface on said substrate in substitution for said first informational message; and e) each of said informational messages having content which is related to the facility at which the pedestrian individuals are being serviced or to products or services which are offered by that facility, such that the at least one element and the path forming elements form a means for queuing the individuals into an organized group of narrow width of such individuals to cause an organized and orderly movement to the at least one element and simultaneously presents at least one message relating to the purpose that such pedestrians are visiting such facility.

10. The system of claim 9 further characterized in that said system further comprises:

a) wait state indicia which defines the standing or waiting position as a location at an end of a line or group of such individuals.

11. The system of claim 9 further characterized in that said system further comprises a plurality of direction indicating elements on said substrate for representing a direction of movement for the group of pedestrian individuals.

12. The system of claim 9 further characterized in that said first informational message is located under a relatively transparent cover member secured to said substrate with a pocket allowing access to said first informational message for removing same and inserting same.

13. The system of claim 12 further characterized in that at least one of said first informational message or second informational message has a raised portion which extends above an upper relatively flat surface of said substrate.

14. The system of claim 12 further characterized in that at least one of said first informational message or second informational message cooperates with the path forming elements and shows or describes a direction of movement of one or more pedestrian individuals.

15. The system of claim 12 further characterized in that at least one of said first informational message or second informational mes sage identifies a particular standing location for an individual in which an activity is to be conducted.

16. The system of claim 12 further characterized in that a foam portion is located with respect to said substrate in order to provide a raised effect to at least one of the first informational message or the second informational message.

17. The system of claim 12 further characterized in that at least one of said first informational message or second informational message is mounted within a recessed portion in said substrate and is removable therefrom.

18. A personnel location and movement control system for guiding a group of pedestrian individuals and also presenting an informational message to said pedestrian individuals, said system comprising:

a) a ground cover substrate for disposition on a ground surface;

b) an end of a line defining element on said substrate representing a location for each successive pedestrian individual who reaches the front of a line of individuals to wait at an end of a line position until he can be received at a destination beyond said end of a line defining element, said end of the line element having wait state indicia defining this location at an end of the line for a queue of the pedestrian individuals;

c) a pair of individual rows of spaced apart small discrete path forming elements associated with said ground cover substrate and extending from opposite ends of the end of the line element in parallel rows to define a relatively narrow pathway with a pair of pathway boundaries for queuing the movement of the pedestrian individuals;

d) an informational message on an upper surface of said substrate arranged in such manner that the message is replaceable by another informational message; and e) each of said informational messages having content which is related to the facility at which the pedestrian individuals are being serviced or to products or services which are offered by that facility or otherwise define a direction of movement with respect to that facility, wherein said ground cover substrate having said end of the line defining element and, said pair of spaced apart rows, queues said group of pedestrian individuals into said line of individuals along said substrate to said end of the line defining element.

19. The personnel location and movement control system of claim 18 further characterized in that each said informational message is located under a relatively transparent cover member secured to said substrate and forming a pocket containino said informational message, and which pocket allows access to said informational message for removing same and inserting same.

20. The personnel location and movement control system of claim 18 further characterized in that each said informational message has a raised portion which extends above the surface of said substrate.

21. The personnel location and movement control system of claim 18 further including in that movement indicator elements on said substrate which show a direction of movement, that said informational message cooperates with said movement indicator elements and shows the direction of movement for one or more pedestrian individuals.

22. The personnel location and movement control system of claim 18 further characterized in that said informational message identifies a particular standing location for an individual in which an activity is to be conducted.

23. The personnel guidance and location control system of claim 18 further characterized in that said discrete elements and elongate element and the pathway defined thereby being sufficiently low to said ground surface that they do not constitute barriers to individuals with ambulatory disabilities or in wheelchairs, such that wheelchairs can easily ride over the discrete elements and the elongate element and individuals with ambulatory disabilities can readily walk over such discrete elements and elongate element.

24. The personnel guidance and location control system of claim 18 further characterized in that a plurality of said substrates are provided and are arrangeable to conform to an existing environment for optimum placement of the group of pedestrian individuals and thereby maximize optimum use of space and to avoid pedestrian traffic congestion, and which substrate and the elements can be relocated to another position pursuant to need therefor.

25. The personnel guidance and location control system of claim 24 further characterized in that said ground cover substrates have end margins on said substrates so that one said substrate is capable of being arranged in abutting relationship with another said substrate to form a desired pattern to thereby generate said selected pathway for the group of individuals.

26. The personnel guidance and location control system of claim 24 further characterized in that said end of the line element is located on one of said substrates a which is spaced slightly apart from an end of the other substrates to represent the end of the line position, but which is cooperatively located with respect to such other substrates to identify an end of the pathway.

27. The system for controlling movement of pedestrian individuals of claim 18 further characterized in that said pathway is of a width sufficient to receive a group of individuals and arranged to guide the group of individuals to the end of the line position and being arranged to conform to an existing environment for optimum placement of a group of pedestrian individuals.

28. The personnel guidance and location control system of claim 18 further characterized in that movement indicator elements are on said substrate to suggest a walking direction of movement in the pathway.

29. The personnel guidance and location control system of claim 28 further characterized in that said movement indicator elements are footprints which are oriented to show a walking movement and suggest a direction of movement toward the end of the line position.

30. A method of guiding a group of pedestrian individuals into a relatively narrow pedestrian pathway while controlling movement thereof toward an activity beyond the end of that pathway, said method comprising:

a) locating ground cover substrate with respect to a ground surface and presenting at least one elongate end of the line element and a pair of spaced apart rows of small discrete path forming elements associated with that end of the line element and extending from opposite ends of the elongate end of the line element creating a defined pathway with a pair of spaced apart pathway boundaries leading to the end of the line element;

b) arranging the orientation of the substrate to conform to art the existing environment so as to optimize use of pedestrian walking space in that environment;

c) causing movement of a group of individuals into a group of narrow width of such individuals on that ground cover substrate;

d) causing the group of individuals to walk in the defined narrow pedestrian pathway formed by the pair of spaced apart rows of the path forming elements to the end of the line position and representing a waiting location for the individual or individuals at the front end of the group of narrow width of pedestrian individuals;

e) insuring the pathway to be sufficiently wide to receive the individuals in the group but sufficiently narrow to guide the group of individuals to the end of the line position and also enabling the group of individuals to be moved in a manner to conform to an existing environment for optimum placement of the pedestrian individuals;

f) allowing each of the individuals who reach the front end of the line to wait their turn at the elongate element until they are ready to be received at the destination; and g) wherein said ground cover substrates having said defined pathway, said elongate element and said width queue said group of pedestrian individuals and cause movement along said ground cover substrate to said elongate element.

31. The method of claim 30 further characterized in that said method comprises:

a) providing wait state indicia at said end of the line element defining a fixed waiting location for the pedestrian individuals and which defines the end of a the line for the queue of the individuals.

32. The method of claim 30 further characterized in that the size of the pathway is established to be less than the width of a conventional passenger automobile.

33. The method of claim 30 further characterized in that indicia is provided on the substrate for viewing by the pedestrian individuals.

34. The method of claim 30 further characterized in that the method comprises locating an informational or advertising message on said substrate so that the pedestrian individuals may readily and easily see the informational message as they walk in the pedestrian pathway.

35. The method of claim 30 further characterized in that the method comprises locating said substrate very close to a ground surface so that the substrate does not constitute a barrier to individuals with ambulatory disabilities or in wheelchairs allowing the wheelchairs to ride over the path forming elements and the end of the line element.

* * * * *